US006651727B1

(12) United States Patent
Prince et al.

(10) Patent No.: US 6,651,727 B1
(45) Date of Patent: Nov. 25, 2003

(54) METHOD AND APPARATUS FOR INJECTING MOLTEN METAL INTO A MOLD

(75) Inventors: Greg A. Prince, Albany, IN (US); Richard L. Smith, Cicero, IN (US); Harry Richey, Shelbyville, IN (US)

(73) Assignee: Delaware Machinery and Tool Co., Inc., Muncie, IN (US)

( * ) Notice: Subject to any disclaimer, the term of this patent is extended or adjusted under 35 U.S.C. 154(b) by 0 days.

(21) Appl. No.: 10/172,320

(22) Filed: Jun. 14, 2002

(51) Int. Cl.[7] ..... B22D 17/10; B22D 17/14
(52) U.S. Cl. ..... 164/113; 164/305; 164/312
(58) Field of Search ..... 164/113, 312, 164/305, 410; 425/420, 812

(56) References Cited

U.S. PATENT DOCUMENTS 4,822,269 A * 4/1989 Kamiyama et al. ..... 425/203
5,601,136 A 2/1997 Shimmell

FOREIGN PATENT DOCUMENTS

| | | |
|---|---|---|
| JP | 58-148066 A | 9/1983 |
| JP | 59-92157 A | 5/1984 |
| JP | 62-101360 A | 5/1987 |
| JP | 63-188465 A | 8/1988 |

OTHER PUBLICATIONS

The North American Die Casting Association of Rosemont, Illinois, 1991.

* cited by examiner

*Primary Examiner*—Kuang Y. Lin
(74) *Attorney, Agent, or Firm*—Brinks Hofer Gilson & Lione

(57) ABSTRACT

Air voids within a die casting may be minimized by controlling, during the shot process, the venting of gas from the shot tube through a shot tube opening with the proper size at a proper location, and the movement of metal within the shot tube to avoid entrapped gas and prematurely solidified aluminum particles in the molten metal being injected into the die cavity during the shot process.

16 Claims, 8 Drawing Sheets

METHOD AND APPARATUS FOR INJECTING MOLTEN METAL INTO A MOLD

TECHNICAL FIELD

This invention relates to methods and apparatus for die-casting, and more particularly, to systems for reducing the inclusion of gaseous voids in die castings.

BACKGROUND OF THE INVENTION

The use of die-casting and plastic molding has been extended to the manufacture of larger and larger articles. Such large automotive parts as internal combustion engine blocks and the housings for automatic transmissions are now commonly manufactured with die-casting as the first step in formation of the part. Such parts have extensive and complex surfaces with close tolerances; and die-casting permits their formation, eliminating costly machining operations and saving metal. Die-casting requires extreme pressures exerted on the liquid metal and large amounts of heat are released from the molten metals as they change state. Massive dies are required to maintain dimensional tolerances within the limits making such operations economically attractive and to provide the strength to withstand the stresses resulting from high pressures and forces. The die-casting molds for such large automotive parts as automatic transmission housings are, for example, frequently seven to eight feet (2.1–2.5 meters) tall, seven to eight feet (2.1–2.5 meters) wide, and six to seven feet (1.8–2.1 meters) thick when closed, and must be manufactured from high-grade, high-tensile strength steel. (The words "mold" and "die" are used interchangeably herein.)

Such molds frequently include one stationary element, one movable element operated by the die-casting machine to close the mold, and several slideable elements referred to as "slides," that move transversely of the direction of movement of the die-casting machine to provide a mold cavity with intricate and re-entrant surface configurations. The mold slides, which slide transversely of the direction of movement of the die-casting machine, are generally moved by hydraulic cylinders to their proper positions.

Die-casting has become desirable as a manufacturing method for parts such as automobile engine blocks and transmission housings because it can produce intricately shaped parts to close tolerances. Thus, die-casting can provide such parts with strength and intricately shaped surfaces without extensive and expensive machining operations. Such parts have wall thicknesses designed to take advantage of the economy of die-casting operations. Misalignment of the mold parts due, for example, to warping of the mold, misalignment of the mold on the molding machine, or non-parallelism in the molding machine platen surfaces or their direction of the movement, can vary wall thicknesses and distort part surface dimensions to unacceptable limits and result in a substantial waste of die-cast parts. In addition, the inclusion of voids within the walls of a casting can create stress concentration sites and can provide undesirably thin areas of the casting's walls. The detection of voids in casting walls is difficult, and failure to detect poorly cast parts before machining can result in further waste.

In die-casting operations, high pressure is needed to fill quickly the intricate cavities of die-casting molds and to avoid premature solidification of the molten metal as the die cavity is being filled. Die-casting machines typically include a "shot tube" connected to a stationary die element so its central cylindrical cavity is in communication with the mold cavity. Molten metal is introduced into the central cavity of the shot tube through a pour hole and is forced into the mold cavity by a piston-driven tip or plunger, (referred to as a "shot tip") that is reciprocally moved in the shot tube cavity. In filling the mold cavity pressures of up to 5500 to 20,000 psi (386–1400 kg/cm$^2$) are exerted by the piston on the molten metal in the shot tube and the mold cavity in each "shot."

In a typical die-casting operation, the shot tube is only partially filled with the volume of metal corresponding to the volume of the die cavity. A shot with a partially filled shot tube is called an "open shot" During an open shot, a wave forms in front of the shot tip as it advances. This wave can entrap air bubbles with the molten metal, ultimately resulting in the formation of voids within the casting. Accordingly the shot portion of the die-casting operation, shot tubes and their operations have been the subject of extensive study and development. Examples of such efforts are disclosed in U.S. Pat. No. 5,601,136 and Japanese Patent Publication Nos. 58-148066, 59-921157, 62-101360 and 63-188465, and Chapter 5, Plunger Velocity & Force, of Die Casting Process Engineering and Control, published by The North American Die Casting Association of Rosemont, Ill., 1991. Japanese Patent Publication 63-188465 discloses one attempt to reduce the inclusion of air from the shot tube by adding, to the shot tube, a slot extending from the pour hole in the direction of the die to act as an air vent and reduce the air forced into the die cavity during the shot, but such slots weaken the ability of the shot tube to withstand the high internal pressures exerted on the molten metal and can lead to structural failure of the shot tube and provide an extended avenue for the escape of molten metal as the shot tube tip is advancing, both of which can provide unsafe operating conditions.

To produce higher quality castings, "closed shot" assemblies have been developed. A closed shot tube has a volume corresponding to the volume of the die cavity. Consequently, the sleeve is completely filled with molten metal and the pour hole is closed before the plunger advances. Such closed shot assemblies require complex moving part assemblies that are exposed to the molten metal and extreme pressures and are not preferred in the die-casting industry.

It is believed that none of the prior developments of the shot portion of a die-casting operation and shot tubes and their operation have addressed the combined effects of heat transfer, wave formations, and air within a shot tube during the injection of molten metal into the die cavity. A need continues to exist for a die-casting method and apparatus, which can be operated reliably to substantially reduce or substantially eliminate voids within die cast parts.

BRIEF STATEMENT OF THE INVENTION

The invention provides an improved apparatus and method for injecting molten metal into the die cavity and rests on the belief that air voids within a die casting may be minimized by controlling, during the shot process, the venting of gas from the shot tube and the movement of metal within the shot tube to avoid entrapped gas and prematurely solidified aluminum particles in the molten metal being injected into the die cavity during the shot process.

In the invention a shot tube for use with open shots in injecting molten metal into a die cavity is provided with a vent opening having a diameter $D_V$, preferably from about 18% to about 27% of the diameter of the shot tube, located downstream of the pour opening, and upstream of the distal end of the shot tube a distance $L_V$, which is substantially equal to $V_M$ and divided by $V_T$ times $L_T$, where $V_M$ is the volume of the metal poured into the shot tube, which is somewhat greater than the total volume of the die cavity, and $V_T$ and $L_T$ are, respectively, the total volume of the shot tube and the length of the shot tube between the shot tip and the distal end of the shot tube (the shot stroke length), and the shot tip is accelerated through the shot tube at a rate maintaining a non-turbulent rising wave of metal in the shot tube until the shot tip is adjacent the vent opening, and is thereafter accelerated to fill the cavity as quickly as possible. Upon filling the cavity, very high pressures are applied to the shot tip by the intensifier to compress the molten metal in the die cavity. In addition, a vacuum can be applied to the die cavity after the shot tip is adjacent the vent opening.

A die casting apparatus of the invention can comprise a die having a part-forming die cavity with a volume $V_M$, a shot tube having a central bore with a length $L_T$ and a volume $V_T$ connected with a die cavity, a pour opening at the rear of the shot tube for introduction of molten metal into the bore of the shot tube, and a vent opening, preferably having a diameter from about 18% to about 27% of the diameter $D_T$ of the shot tube bore, located a distance $L_V$, equal to $V_M$ divided by $V_T$ times $L_T$, from the distal end of the shot tube connected with the die cavity, the shot tube having a shot tip reciprocatably carried within its bore between its rear and its distal end for urging molten metal into the die cavity, means for introducing at least a volume of $V_M$ of molten metal through the pour opening into the shot tube bore between the shot tip and the distal end of the shot tube, and means for advancing the shot tip towards the distal end of the shot tube to force molten metal into the die cavity, said advancing means being operable to accelerate and advance the shot tip at a rate forming a rising but non-turbulent wave of molten metal in front of the shot tip until the shot tip has covered the vent opening and to thereafter advance the shot tip at a rapid rate until the die cavity is filled with molten metal and thereafter being operable to apply extremely high pressure on the molten metal in the die cavity.

The invention also provides a die casting method comprising the steps of providing a shot of molten metal having at least a volume $V_M$, at least equal to the volume of the die cavity, through a pour opening to partially fill the bore of a shot tube having a total volume $V_T$, with the bore of the shot tube being connected with the part-forming cavity of a die, and advancing a shot tip within the bore of the shot tube to form a rising substantially non-turbulent wave of molten material within the shot tube and to expel gas from above the rising wave of molten metal through a vent opening located a distance from the distal end of the shot tube equal to about to $V_M$ divided by $V_T$ times $L_T$, where $V_M$ is a volume of the molten metal of the shot tube, and $V_T$ and $L_T$ are, respectively, the total volume of the shot tube between its distal end and the shot tip, and the total length of the shot tube between its distal end and the shot tip, and after the shot tip has closed the vent opening rapidly advancing the shot tip to fill the die cavity and intensifying the force applied to the shot tube to exert extreme pressure on the molten metal in the die cavity, preferably at reduced rates. The method can also include applying a vacuum to the die cavity about the time the shot tip has closed the vent opening.

Other features of the invention will be apparent from the drawings and more detailed description of the invention that follow.

BRIEF DESCRIPTION OF THE DRAWINGS

FIG. 5 illustrating the shot tube being filled with molten metal;

FIG. 6 illustrating the shot tube and molten metal after the shot tip has started its movement;

FIG. 7 illustrating the shot tube and molten metal when the shot tip is adjacent to the vent opening; and FIG. 8 illustrating the shot tube and molten metal after the shot tip has closed the vent hole;

BEST MODE FOR CARRYING OUT THE INVENTION

Figure 1:
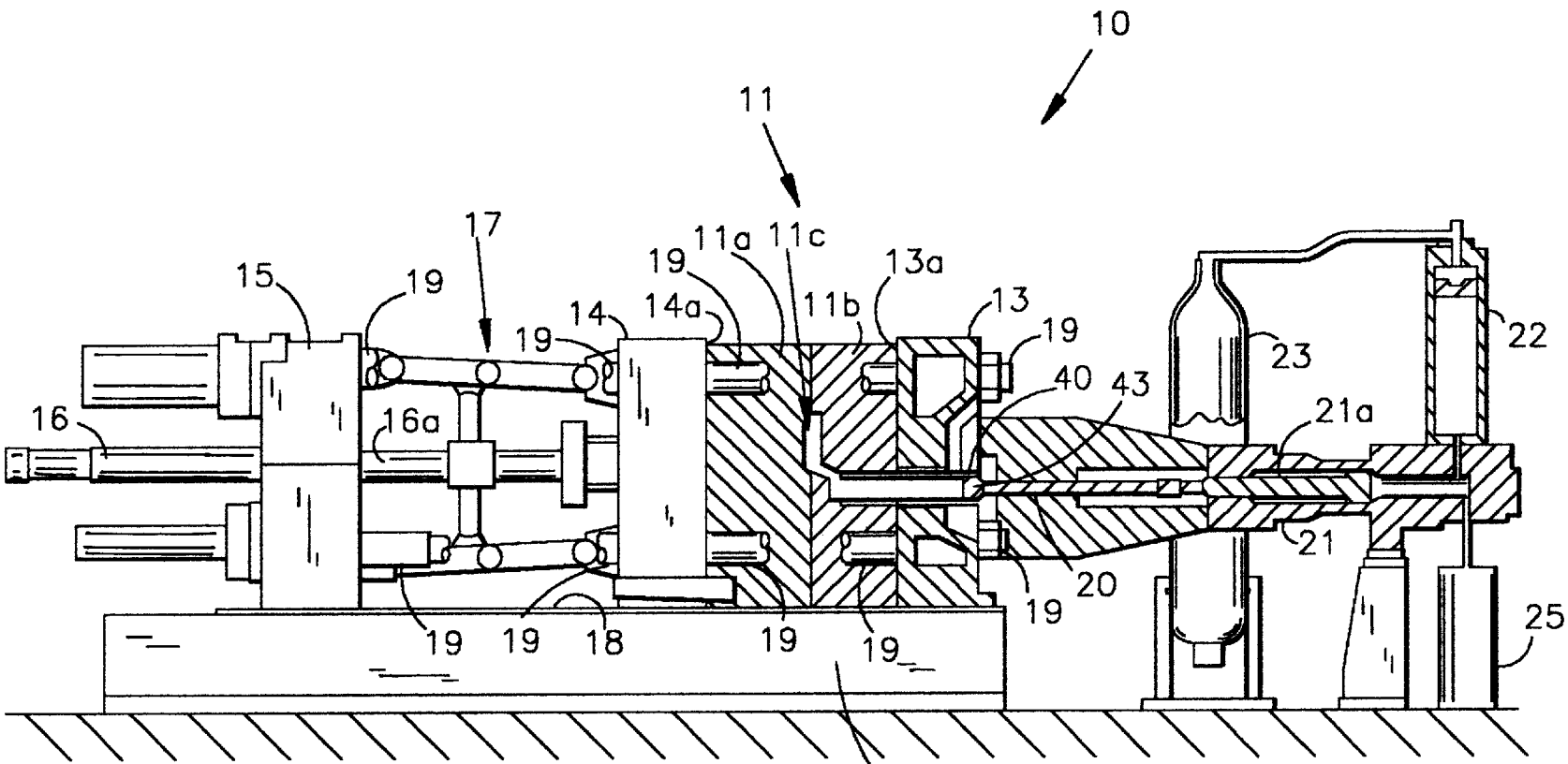
FIG. 1 is a cross-section of a typical horizontal die-casting machine.

FIG. 1 is a cross-sectional and diagrammatic view of a typical, horizontal, die-casting machine 10. The die-casting machine is designed to open and close a die-casting mold 11, frequently referred to as a die, including a movable element 11*a* and a stationary element 11*b*. The die-casting machine includes a base 12 adapted to support a stationary platen 13 and a movable platen 14. Stationary platen 13 and movable platen 14 are supported by the base in such a manner that their vertical surfaces 13*a* and 14*a*, respectively, are parallel. The parallel nature of vertical surfaces 13*a* and 14*a* of the platens of the die-casting machine is important to ensure that parallel surfaces provided on a movable portion 11*a* and stationary portion 11*b* of mold 11 remain parallel when the die is installed in the machine and as the mold is closed, that is, as movable platen 14 is moved by the die-casting machine, toward stationary platen 13. As shown in FIG. 1, the die-casting machine also includes a link housing 15 carried by base 12, and a hydraulic cylinder 16 carried by the link housing 15 with its piston moving horizontally. A piston 16*a* of hydraulic cylinder 16 is connected to a toggle link assembly 17. Toggle link 17 provides a large mechanical advantage, multiplying the force imposed by piston 16*a* of hydraulic cylinder 16 many times to move movable platen 14 toward stationary platen 13 and, upon engagement of the interfacing surfaces of movable die element 11*a* and stationary die element 11*b*, to apply extremely high forces to press movable die element 11*a* against stationary die element 11*b* to resist the separating forces imposed upon die elements 11*a* and 11*b* by the liquid metal shot forced into a cavity 11*c* formed in die 11.

As shown in FIG. 1, the die-casting machine 10 includes a shot tube 40 into which molten metal is poured. The molten metal is forced into cavity 11*c* by a movable shot tip 43 in the shot tube 40, which is advanced by a shot rod 20 driven by a piston 21*a* in hydraulic cylinder 21. The piston 21*a* is moved forward in the hydraulic cylinder 21 at a rate controlled by hydraulic flow control means 25. The hydraulic flow control means controls the hydraulic fluid that drives shot rod 20 and piston 21*a* by providing an adjustable, programmable controlled rate of flow at a substantially constant pressure to advance the shot tip 43 at a controlled rate within the shot tube, and upon completion of the forward stroke of shot rod 20, the piston 21*a* is exposed to an extremely high intensification pressure, frequently in the range of 1,000 to 6,000 psi (20 to 422 kg/cm$^2$). The intensifier includes an isolating hydraulic piston assembly, and the high pressure of high-pressure container 23 is applied to isolating piston assembly 22 and through the hydraulic fluid to shot rod 20 and is multiplied by the piston 21*a* and shot tip 43 to exert pressures such as 5,500 to 20,000 psi (386 to 1400 kg/cm$^2$) on the molten metal within shot tube 40 and cavity 11*c*. To prevent the extreme high pressures of the molten metal from forcing die elements 11*a* and 11*b* apart, die-casting machine 10 through toggle link 17 can apply forces of several million pounds, and up to 7,000,000 pounds (3,178,000 kilograms), to movable platen 14.

Various means have been applied to avoid air from being trapped in the die cavity during the casting process. In addition to the air exhaust permitted at the interfaces between the die elements, large dies are frequently provided with additional air vents to allow the molten metal to push air from the die cavity as it is being injected into the die. In addition, the removal of air from the die cavity is sometimes assisted by vacuum generators connected with air vents leading to the die cavity.

As shown in FIG. 1, movable platen 14 and movable die 11*a* are supported by rails 18 on the base; and both movable platen 14 and movable die member 11*a* are carried and guided by tie bars 19 extending between stationary platen 13 and link housing 15 supported by base 12. Tie bars 19 must carry the force imposed by piston 16*a* and toggle link 17 and imposed, through movable platen 14 and mold 11, on stationary platen 13. Stationary platen 13 and link housing 17 are held together by tie bars 19 to permit the extreme forces to be imposed upon die elements 11*a* and 11*b* by toggle link 17 of the die-casting machine. Tie bars 19 are broken away in FIG. 1 so that they will not restrict the view of toggle link 17 and die elements 11*a* and 11*b* (which are shown in cross section).

As shown further in FIG. 1, if the interfacing surfaces of die elements 11*a* and 11*b* are prevented by an incompressible material, such as flash, from mating and are held spaced apart, the designed preloading force to be applied by the die-casting machine through toggle link 17 can be many times greater than anticipated and can reach levels sufficient to break the toggle link assembly or tie bars of the die-casting machine. As noted above, the forces imposed by the die-casting machine are frequently in the range from 700,000 to 7,000,000 pounds (317,800 to 3,178,000 kilograms).

FIGS. 2–3 illustrate a mold to form, from aluminum, for example, the housing for an automatic transmission for an automobile.

Figure 2A:
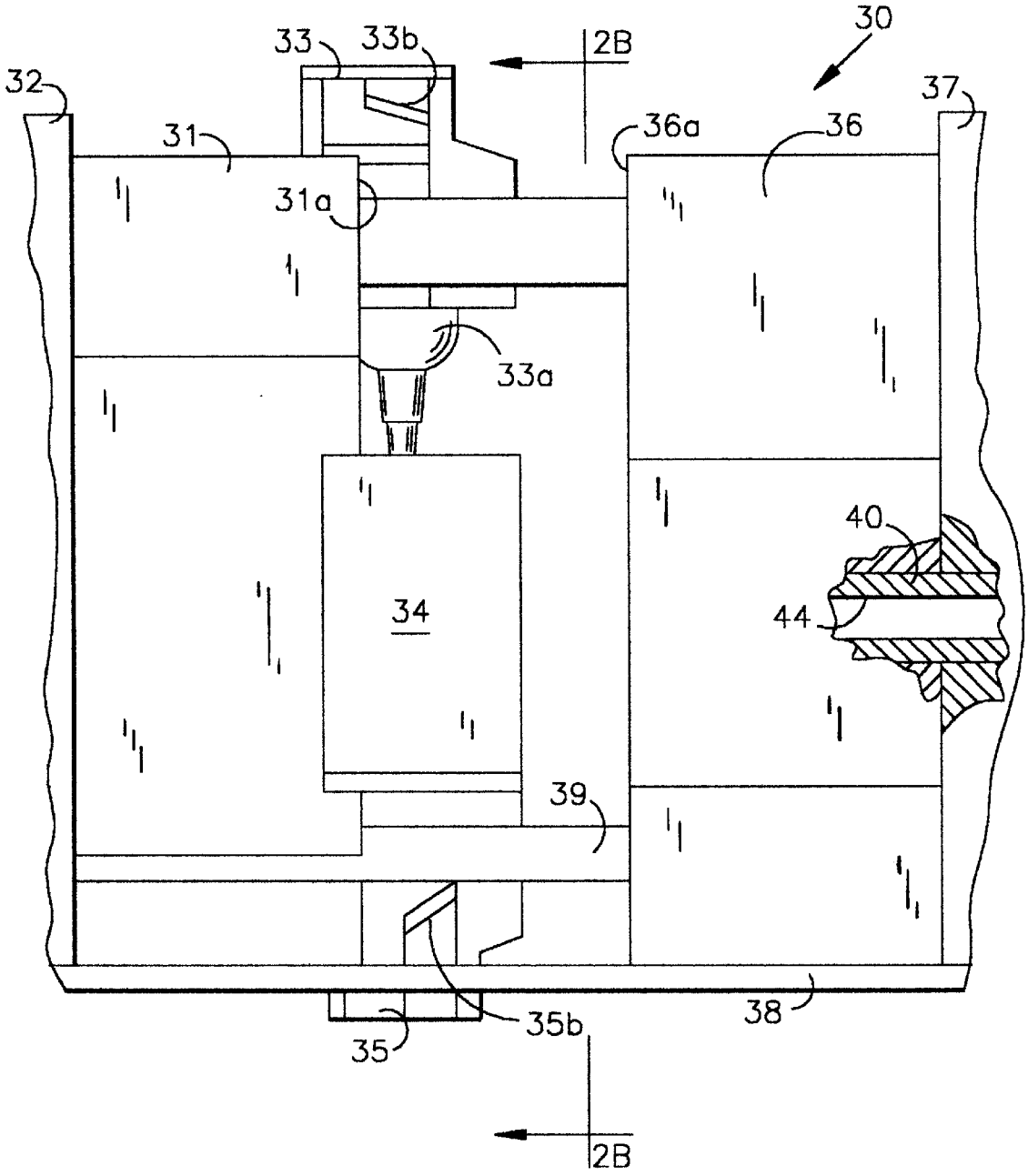
FIG. 2A is a side view of a typical mold for the housing of an automatic transmission of an automobile in the open position, with portions of the stationary platen and die element broken away to illustrate the die-casting machine shot tube and die element passageway.
Figure 2B:
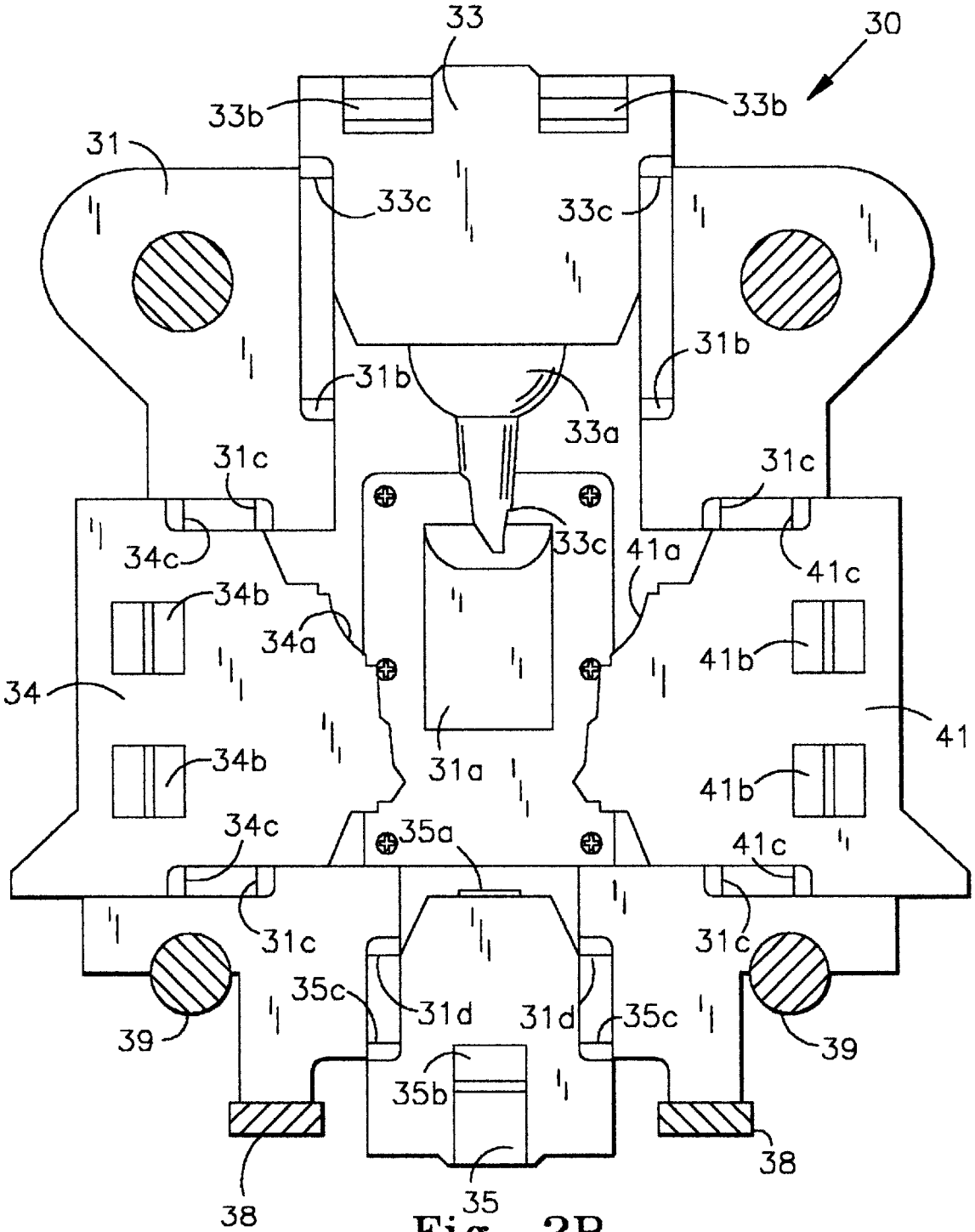
FIG. 2B is a cross-sectional view taken on line 2B—2B of the mold of FIG. 2A, showing the movable carrier of the mold and the plurality of transversely moving mold slides to form the interior of the transmission housing, its upper most surface (by the carrier) and its outer and end portions.

FIG. 2A is a diagrammatic side view of a molding system 30 with the mold in the open position. As shown in FIGS. 2A and 2B, the mold includes a movable mold element, or carrier, 31 mounted on the face of a movable platen 32 of a molding machine and carrying a plurality of transversely sliding mold elements, namely, a top slide 33 including a surface portion 33*a* shaped to form the interior surface of the automatic transmission housing, a side slide 34 having an interior surface shaped to form a portion of the outer surface of the automatic transmission housing (not shown), and a bottom slide 35 shaped to form the end of the automatic transmission housing. Another side slide 41 is carried by mold element 31 as shown in FIG. 2B. The mold system also includes a stationary die element 36 including interior portions (not shown) which cooperate with the cavity-forming surfaces of movable die element 31 and sliding die elements 33, 34, 35, and 41 (shown in FIG. 2B) to complete the formation of an internal cavity when movable element 31 is closed by movable platen 32 of the die-casting machine to force the interfacing and mating surfaces 31*a* and 36*a* of die element 31 and die element 36 into engagement. Prior to the movement of movable die element 31 into engagement with stationary die element 36, sliding die elements 33, 34, 35, and 41 (shown in FIGS. 2B and 3B) are moved transversely and preferably perpendicularly to the direction of motion imposed on movable die element 31 by movable platen 32 of the die-casting machine. Slides 33, 34, 35, and 41 (FIG. 2B) are moved by separate hydraulically driven pistons mounted on die element 31 and fastened one to each of slides 33, 34, 35, and 41 (FIG. 2B) to move the slides. The mounting and operation of such hydraulic piston-cylinders to drive the slides of a die-cast mold are well known in the art, and the hydraulic piston-cylinder drives are omitted from FIGS. 2–3 for clarity.

FIG. 2B is a view of the carrier and slides of mold system 30 taken along section 2B—2B of FIG. 2A. FIG. 2B shows the arrangement of slides 33, 34, and 35, and the other side slide 41, which is opposite side slide 34 and not visible in FIG. 2A. As shown in FIG. 2B, movable die element 31, which serves as a carrier for the slides, includes an interior portion 31*a* including surfaces designed to cooperate with the cavity-forming surfaces 33*a*, 34*a*, 35*a*, 36*a*, and 41*a* of die elements 33, 34, 35, 36 and 41 to form the automatic transmission housing. Interior surfaces 34*a* of slide element 34, 35*a* of slide element 35, and 41*a* of slide element 41, as well as a more complete view of the exterior of cavity-forming surface 33*a* of top slide element 33 are shown in FIG. 2B.

As illustrated in FIG. 2A by the partially broken away portions of stationary die element 36 and stationary platen 37, the die casting machine includes a shot tube 40 carried by the stationary platen 37 so its cylindrical interior bore 44 is in communication with a molten-metal carrying passageway through which molten metal is forced into the mold cavity.

Figure 3A:
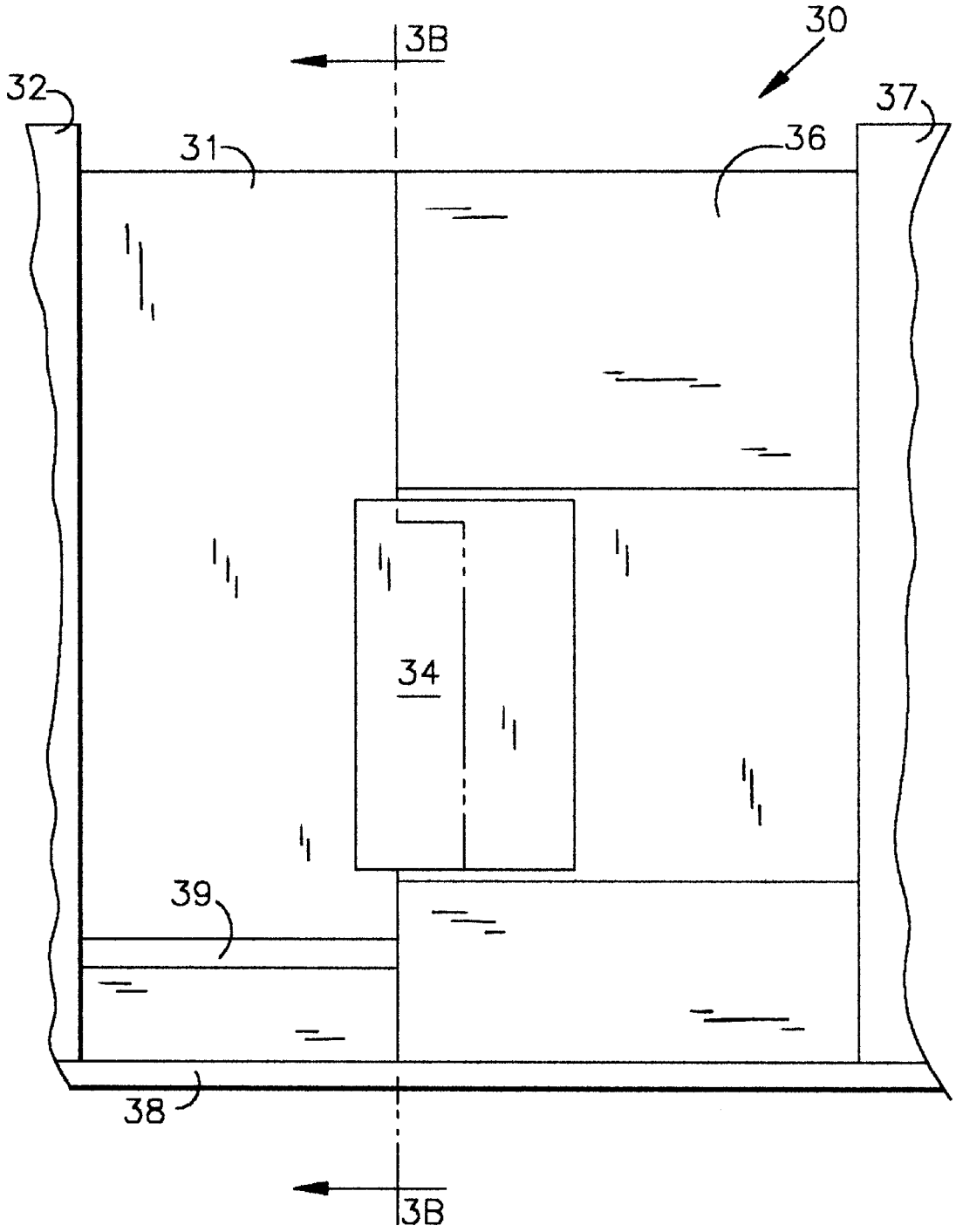
FIG. 3A is a side view of the mold of FIGS. 2A and 2B in the closed position.
Figure 3B:
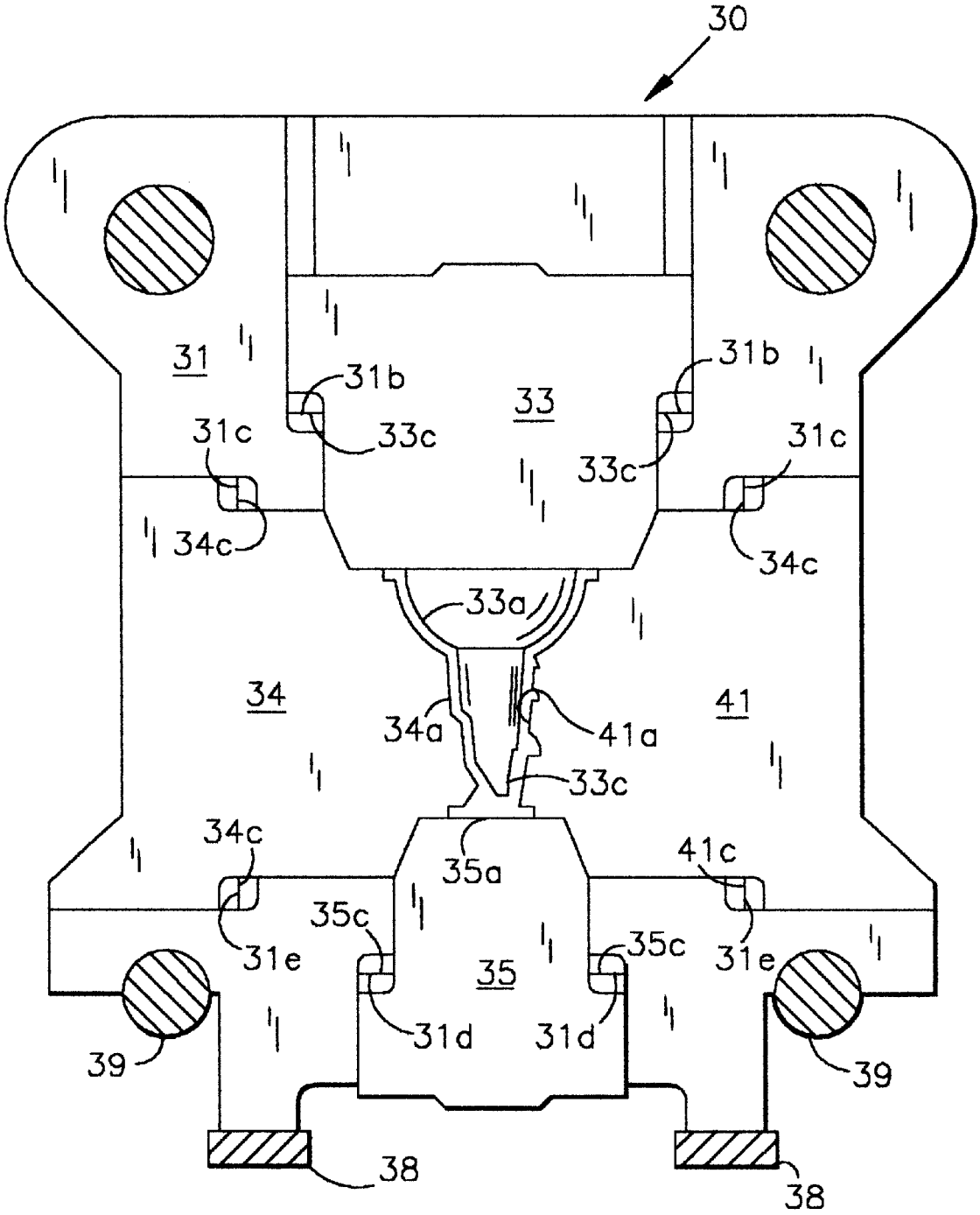
FIG. 3B is a cross-sectional view taken on line 3B—3B of the mold system of FIG. 3A showing the position of the slides with the mold closed and indicating a cross-section of the cavity formed by the mold.

FIGS. 3A and 3B correspond, respectively, to FIGS. 2A and 2B and show mold system 30 in the closed position. FIG. 3B is a cross-section of FIG. 3A taken along the lines 3B—3B of FIG. 3A. Section 3B—3B is taken along the parting line (that is, the interface between mold elements 31 and 36) but offset through the center line of the mold cavity to more clearly show the manner in which the mold elements define the housing of an automatic transmission. In the position shown in FIG. 3A, the die-casting machine through movable platen 32 applies force reaching millions of pounds to molding system 30 to clamp and wedge molding system 30 in the closed position and to prevent molding elements 31 and 36 from being forced apart, that is, so no spacing occurs between die elements 31 and 36, when exposed to the pressure imposed on the liquid metal as it is forced into the mold cavity. Through the high forces imposed on movable die element 31 by movable platen 32 of the die-casting machine and its transfer via ramp-like surfaces 33*b* of top slide 33, 34*b* of side slide 34, and 41*b* of side slide 41, and 35*b* of bottom slide 35 (FIG. 2B), slides 33, 34, 41 and 35, respectively, are intended to be held in the proper closed position defined by the adjoining slide and carrier stops as shown in FIG. 3B. In a larger part such as a housing for an automatic transmission which requires a slide element such as a top slide element 33 shown in FIGS. 2–3 to form its long interior cavity, even a small, angular displacement from its intended central axis can displace its remote end surface (see 33*c* in FIGS. 2B and 3B) by many thousands of an inch and result in the manufacture of a housing with a wall thickness too thin to provide reliable operation and service, particularly if there are voids formed in the wall by air that is carried into the mold with, or entrapped within the mold by, the molten metal.

For large castings, such as the aluminum casting for an automatic transmission housing, a complete cycle, including closing the mold, charging the mold, cooling the charge and opening and clearing, the mold requires from about two minutes to about two and one-half minutes.

A typical housing for an automatic transmission maybe eighteen to twenty inches (45 to 50 cm) in diameter and twenty to twenty-four inches (50 to 60 cm) long. Referring to FIG. 3B, if the molten metal exerts a pressure of 5,500 psi to 20,000 psi (386 to 1400 kg/cm$^2$) on the cavity-forming surfaces of molding system 30, the forces tending to move mold slide elements 33, 34, 41, and 35 outwardly away from the cavity may reach several million pounds (several million kilograms) acting on each of the slide elements 33, 34, 35, and 41.

The imposition of pressures such as 5,500 psi to 20,000 psi (386 to 1400 kg/cm$^2$) on the liquid metal within the shot tube 40 (FIG. 2A) and mold cavity can also impose forces on the order of millions of pounds (millions of kilograms) acting to expand the shot tube 40 and to force mold elements 31 and 36 apart. The die-casting machine, through the imposition of the forces of 350 to 3,500 tons (317,000 to 3,171,000 kilograms) or more, must hold the die elements 31 and 36 closed and hold slide elements 33, 34, 35, 41 in their designed closed portion, notwithstanding the high pressures imposed on the liquid metal shots.

Figure 4:
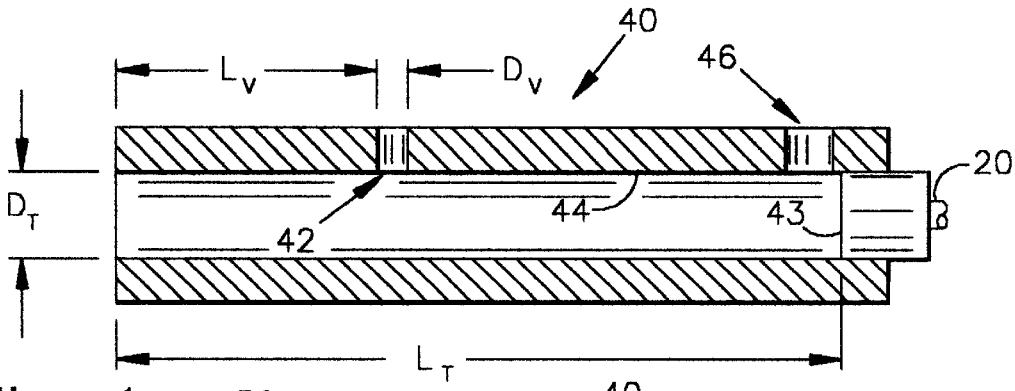
FIG. 4 is a cross-sectional view of cylindrical shot tube of the invention taking at a plane including the central axis of the cylindrical shot tube and showing the location of a vent opening provided adjacent the distal end of the shot tube.

FIG. 4 illustrates a shot tube 40 of the invention. Shot tubes are typically cylinders that are fabricated from high-grade tool steel of special compositions in order to withstand the extreme heating and cooling cycles that are experienced during the casting process. Shot tubes typically have lengths of about two to about four feet and central bores with diameters ($D_T$) of about two to about six inches, and the shot tubes are exposed to internal pressures as high as 20,000 pounds per square inch (1400 kg/cm$^2$) at their distal ends during the operation of the intensifier. Accordingly, the walls of the shot tube are generally several inches thick.

As well known in the art, the shot tube cylinder 40 is provided with a pour hole 46 adjacent to its rear end to admit a charge of molten metal to be inserted within the shot tube. The volume of the charge $V_M$ inserted into the charge tube is at least equal to and is generally somewhat more than the volume of the die cavity, to fill the die cavity and the runners of the die. In manufacturing a shot tube for use with a die, the shot tube bore ($D_T$) and length are determined by the stroke length ($L_T$) of the shot rod 20 of the die casting machine and the volume of metal $V_M$ needed to fill the die cavity. The bore and stroke length of the shot tube provide a total volume $V_T$ equal to $$\left(\frac{\pi}{4}D_T^2 \times L_T\right)$$

which is generally more than about twice the volume of the die cavity $V_M$, and sometimes up to about four times the volume $V_M$ of the die cavity, and is preferably sized so that the volume of the metal charge $V_M$ is 30–40% of the total volume $V_T$ of the shot tube 40.

As illustrated in FIG. 4, a vent hole 42 is provided in the distal end of the shot tube 40 at a distance $L_V$ from the distal end of the shot tube, which is preferably determined by dividing the volume of the metal charge $V_M$ by the total volume of the shot tube $V_T$ and multiplying the length of the shot stroke $L_T$ by the resulting ratio. That is, $L_V$ equals $V_M$ divided by $V_T$ times $L_T$. The vent hole 42 should be as small as possible to avoid weakening the ability of the shot tube to withstand the stresses imposed by internal pressures and temperature. The vent hole 42 will preferably be at the top of the shot tube 40 and have a diameter determined as follows:

| Shot Tube Bore Diameter $D_T$ - inches | Vent Diameter $D_v$ - inches |
|---|---|
| Less than 3.0 OD | .62 OD |
| 3.0 to 4.0 | .75 OD |
| 4.0 to 5.5 | 1.00 |
| 5.5 up | 1.50 |

As shown by the table, the vent diameter is, generally, from about 18% to about 27% of the diameter of the shot tube bore.

In installation the cylindrical shot tube 40 is inserted horizontally through the stationary platen 37 of the die casting machine into the stationary or cover element 36 of the die. As indicated above, the shot tip 43 is reciprocatably carried within the bore 44 of the shot tube 40.

FIGS. 5–8 and FIGS. 9 and 10 illustrate the operation of the shot tube 40 in the invention.

Figure 5:
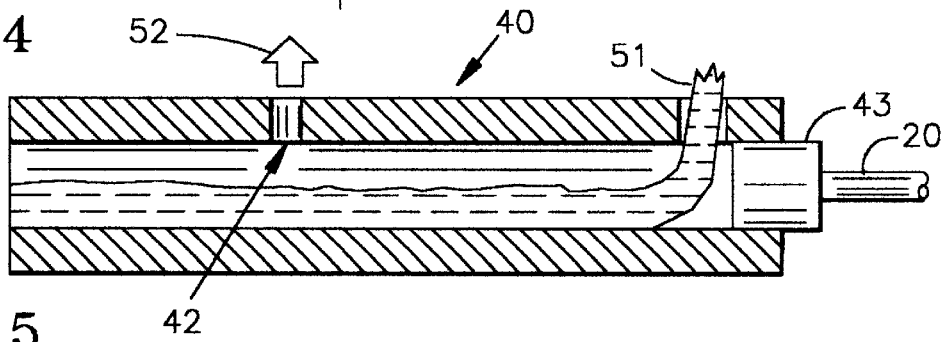
FIGS. 5—8 are cross-sectional views of the shot tube of FIG. 4 to illustrate its operation during the shot process.

In operation, after a die is closed, the charge of molten metal 51 is introduced into shot tube 40, as illustrated by FIG. 5 by means providing a controllable volume of molten metal $V_M$. Such means can be a ladle of selected volume, a valve controlled to provide a controlled volume of metal or other such apparatus known in the art. The molten metal is typically at a temperature on the order of 1,200 to 1,300 degrees Fahrenheit. Upon introduction of the molten metal into the shot tube 40, the shot tube 40 and the atmospheric air and any foreign matter, such as residue lubrication, within the shot tube become rapidly heated, quickly reaching temperatures of 500 degrees Fahrenheit and more. As a result of heat transfer from the molten metal, a rapid expansion of air and vapors present in the shot tube results. Any lubricant that may be present in the tube can be violently converted by the molten metal into gas, which also attempts to escape from the shot tube. Typically, the gas escape path from the shot tube 40 through the die and the die vents is torturous with high resistance to rapid flow, and vent hole 42 permits the rapidly expanding mass of gas to readily escape from within the cast shot tube, as indicated by arrows 52, and greatly reduces the possibility of expanding gas flowing outwardly through the pour hole 46. Vent hole 42 also reduces the number of air vents that must be provided in a die, reducing the die cost and the possibility of air vent plugging and cleaning.

The shot tip 43 is advanced within bore 44 of shot tube 40 with controlled acceleration $S_M$ which avoids the creation of significant turbulence in the molten metal 51 within the shot tube. Acceleration of the shot tip 43 is controlled, in the illustrated embodiment, by a hydraulic flow control means 25 (See FIG. 1), which introduces hydraulic fluid into cylinder 21 at a rate providing the controlled advancement of shot rod 20 and shot tip 43. The hydraulic flow control 25 can include a programmable microprocessor with an algorithm producing the desired shot tip advancement, or it can be an analog control providing controllable preset hydraulic flow rates that generate the desired acceleration and velocity of the shot tip 43, or other equivalent hydraulic flow control means. Those skilled in the art will recognize that other means can be used to control the advance the shot tip 43 within the shot tube to avoid significant turbulence in the molten metal.

Figure 6:
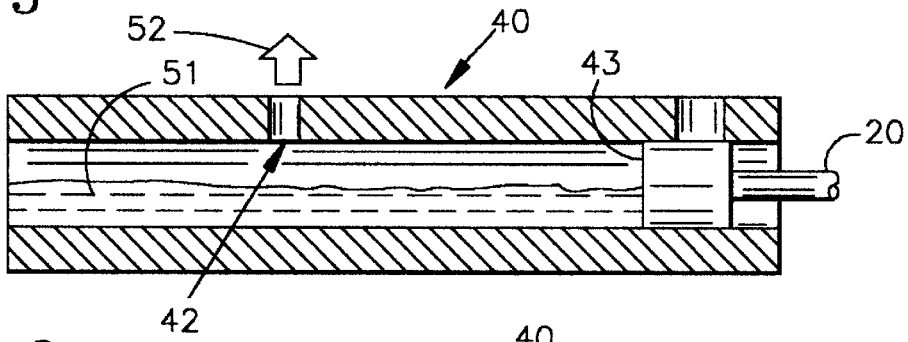

As illustrated by FIG. 6, after the shot tube has been filled with the metal charge 51, the shot tip 43 slowly accelerates at a controlled rate avoiding the formation of a turbulent wave of molten metal in the shot tube. (See FIG. 10 for example.) As the shot tip 43 advances, the rising wave of molten metal 51 within the shot tube due to the reducing volume within the shot tube 40 created by the advancing shot tip 43, and a continued transfer of heat from the molten metal 51 to the gas within the shot tube, continue to provide a rapid escape of heated gas from the vent opening 42, as indicated by arrow 52.

Figure 7:
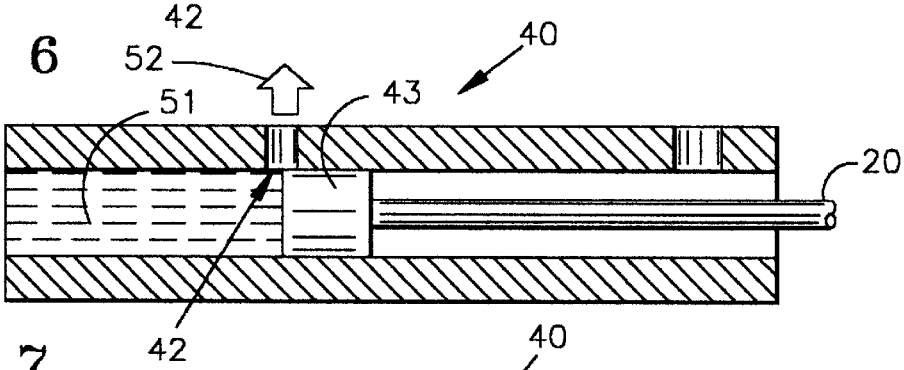

As illustrated by FIG. 7, by the time the advancing shot tip 43 is adjacent to vent hole 42, substantially all the gas within the shot tube has had an opportunity to escape through vent hole 42. The temperature of the distal end of the shot tube 40 and any small mass of remaining air with the shot tube are very high, possibly as high as 1000 degrees Fahrenheit. The controlled acceleration and advance of the shot tip 43 to the point where it is adjacent to vent hole 42 avoids creation of large surface areas of molten metal that are exposed to the cooler and possibly solidifying temperatures within the shot tube and avoids creation of solidified or partially solidified particles of aluminum and trapped air within the molten metal charge 51 to be urged into the die cavity.

Figure 8:
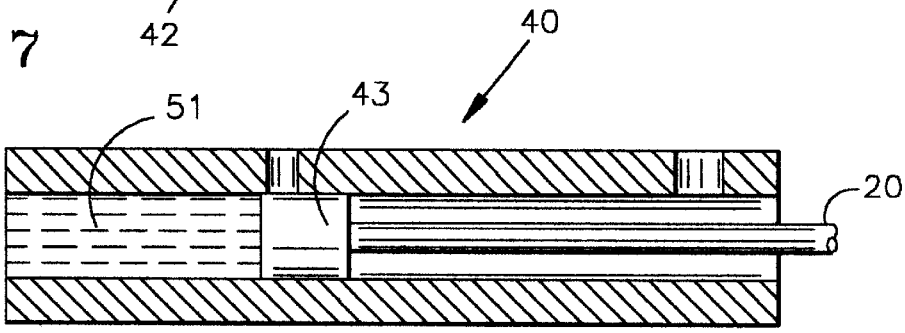

As illustrated by FIG. 8, shot tip 43 has traveled to the point where vent opening 42 is closed, about a distance $L_T$–$L_V$, and no further gas can escape from within the shot tube 40. Also at this location, substantially the entire distal end of the shot tube forward of shot tip 43 is filled with metal charge 51, and the shot tip 43 can be rapidly advanced to force the metal charge 51 into the die cavity.

When the shot tube 43 has reached the distal end of the shot tube 40 and the die cavity has been filled with molten metal, the intensifier is triggered, imposing a force on the shot tip 43 that generates as much as 20,000 pounds per square inch (1400 kg/cm$^2$) on the molten metal within the die cavity. It is believed that the intensification pressures should be imposed at a reduced rate compared with prior injection processes for the same or equivalent castings, for example, at average rates of pressure increase less than about 10,000 to 12,000 psi per second, and preferably at average rates about two-thirds or less than prior average rates of pressure increase for the same castings and as low as about 5,000 psi per second. Less rapid increases in intensification pressure reduce the exposure of hydraulic lines and components to rapid expansion and contraction and the resulting stresses and may provide a partial solidification of the molten metal closing air vents and parting lines and reducing the die areas exposed to the intensification pressure and its separating effect on the elements of a closed die.

In systems using a vacuum to pull air from the die cavity during casting, the application of vacuum to the die casting can be delayed, and the vacuum can be turned on at the same time that the vent opening 42 is closed, after the shot tip has traveled a distance $L_T$–$L_V$, rather than being turned on at the beginning of the shot, i.e., when the shot tip 43 begins to move. With the use of the invention, the vacuum system can more effectively remove air and gas from the die cavity.

Figure 9:
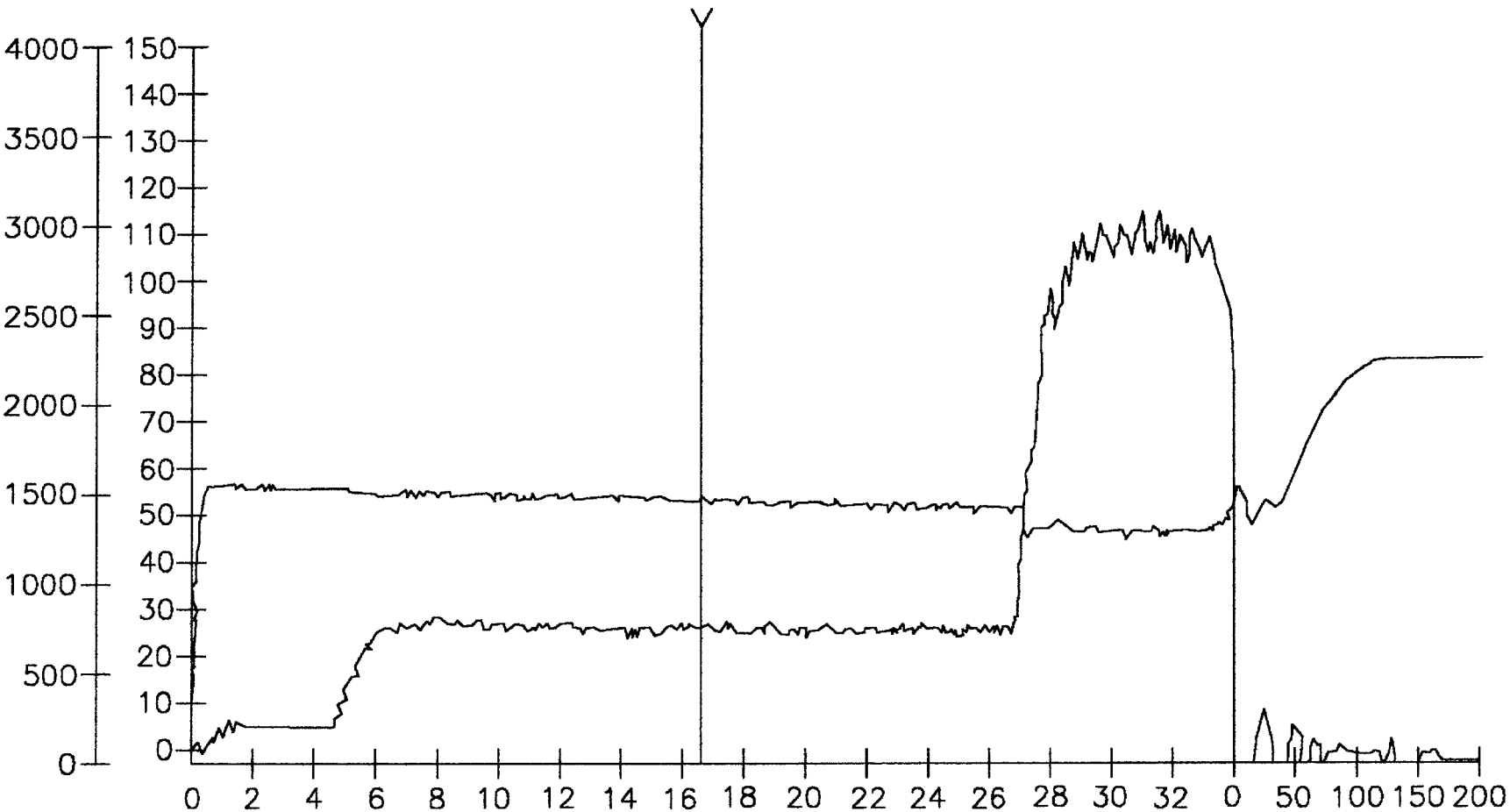
FIG. 9 is a graph illustrating the operation of a prior art shot tube in filling a die cavity.

The invention and its benefits are illustrated by the following examples. In this comparison, a plurality of transmission housings weighing about 22 pounds were die cast using cylindrical shot tubes 34.5 inches long having a bore with an inside diameter of 5 inches. The first series of transmission housings were cast using a shot tube with a shot stroke length 34 inches long, with a 5-inch diameter bore and having no vent hole. FIG. 9 is a graph illustrating, in the lower trace, the velocity of the shot tip 43 between its starting and ending position, which are at 0 inches and at 34 inches on the abscissa of the graph, and, in the upper trace, the hydraulic pressure applied to the shot rod 20 driving the shot tip 43, and illustrates operation of the shot portion of a casting process, which is typical of such operations prior to the invention. At the ending position of the shot tip 43 (that is, at 34 inches on the abscissa), the die cavity is filled with molten metal, and the units which x axis indicates and in which the abscissa is calibrated switches from inches to milliseconds to illustrate the pressure-time curve during the period that the pressure on the molten metal in the filled cavity is intensified.

As illustrated in FIG. 9, after the shot tip 43 has traveled past the pour hole, about 4½ inches from its starting point, the velocity of the shot tip is accelerated to a velocity of 27 inches/second and maintained at this velocity until the shot tip 43 has traveled 26 inches, at which position molten metal has reached the gates of the die cavity, and the velocity of the shot tip is rapidly accelerated to about 110 inches/second until the die cavity is filled; at this time, indicated by the 0 at the right end of the abscissa, the pressure applied to the shot tip is rapidly increased, achieving, in this example, a maximum pressure within 100 milliseconds. The use of this prior art casting process resulted in a scrap rate of 4.5% due to casting porosity.

Figure 10:
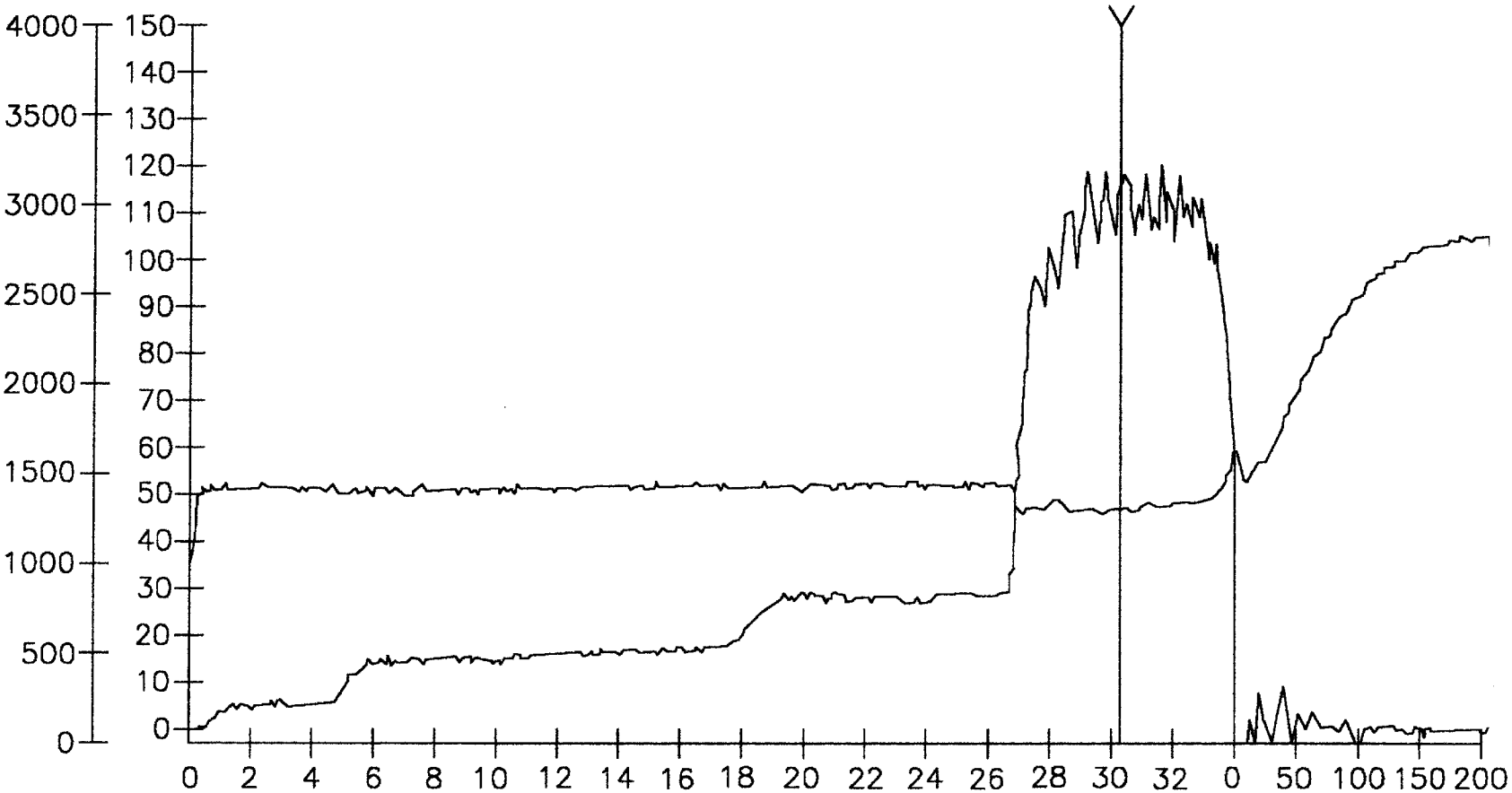
FIG. 10 is a graph illustrating the operation of the invention in filling the same die cavity.

A plurality of the transmission housings were then cast using the invention. In the invention a vent hole 42 was added to the shot tube at a distance $L_V$ of 15 inches from the distal end of the shot tube, which is at 34 inches on the abscissa. FIG. 10 illustrates, in the lower trace, the velocity of shot tip 43 between its starting and ending position (i.e., between 0 and 34 inches on the abscissa in FIG. 10). After the shot tip 43 has traveled past the pour hole, at about 4½ inches on the abscissa, the shot tip 43 was accelerated to a velocity of only about 16 inches per second and maintained at about 16 inches/second until the shot tip 43 closed the vent hole 42, at about 19 inches on the abscissa. The advancement of the shot tip 43 at such a rate, with a velocity of less than 18 inches/second, avoids significant metal turbulence within the shot tube and allows minimization of the mass of gas injected into the die cavity. Thereafter, the shot tip 43 was controlled to travel at the same velocity as in the prior art operation of FIG. 9. After the cavity was filled, at 34 inches on the abscissa of FIG. 10, an intensified pressure was applied to the molten metal in the filled cavity, but the intensification pressure was applied at a slower rate than in the prior art operation of FIG. 9, using about twice the time to reach maximum applied pressure. With the invention, the scrap rate was reduced from 4.5% to about 0.7%, reducing the number of scrap castings to less than one-sixth of the scrap resulting from the prior art operation.

Although the invention as been described in detail with reference to a preferred embodiment and mode of operation, those skilled in the art will recognize that variations and modifications exists within the scope and spirit of the invention as set forth in the following claims.

What is claimed is:

1. In a die casting apparatus, a die having a part-forming die cavity having a volume $V_M$;

a shot tube having a bore with a diameter $D_T$ connected with the die cavity, and also having a pour opening at its rear for the introduction of molten metal, said shot tube having a shot tip reciprocatably carried within its bore between its rear end and its distal end to provide a shot stroke length of $L_T$ and an internal shot tube volume $V_T$;

a vent opening located a distance $L_V$, equal to $V_M$ divided by $V_T$ times $L_T$, from the distal end of the shot tube;

first means for introducing a volume $V_M$ of molten metal through the pour opening and within the bore of the shot tube between the shot tip and the distal end of the shot tube; and second means for advancing the shot tip toward the distal end of the shot tube to force molten metal into the die cavity;

said second means being operable to advance the shot tip at a rate forming a rising but non-turbulent wave of molten metal in front of the shot tip until it has traveled a distance about equal to $L_T$–$L_V$ and to thereafter advance the shot tube at a rapid rate until the die cavity is filled with molten metal, and to exert extremely high pressure on the molten metal in the die cavity.

2. The apparatus of claim 1, wherein said vent opening has a diameter $D_V$ in the range of about 18% to about 27% of the diameter $D_T$.

3. The apparatus of claim 1 further comprising means for impressing a vacuum on the die cavity.

4. The apparatus of claim 3, wherein said vacuum impressing means includes a control to impress a vacuum on the die cavity at about the time the shot tip has traveled a distance $L_T$–$L_V$.

5. The apparatus of claim 1, wherein said second means is operable to apply said extremely high pressure at an average rate of about 12,000 psi per second or less.

6. In a die casting method for transferring molten metal from a shot tube having an internal bore with a diameter $D_T$ and a shot stroke length $L_T$ to a part-forming cavity having a volume $V_M$, the steps of providing a shot of molten metal having a volume $V_M$ within the shot tube to partially fill the shot tube bore, said shot tube bore having a volume $V_T$, equal to $$\frac{\pi}{4}D_T^2 L_T,$$

and being connected with the part-forming cavity;

providing said shot tube with a vent opening located a distance $L_V$, equal to about $$\frac{V_M}{V_T} \times L_T,$$

from the distal end of the shot tube, advancing a shot tip within the bore of the shot tube to form a rising wave of molten metal within the shot tube and to expel gas from above the rising wave of molten metal through the vent opening;

said shot tip being advanced, within said bore, at a rate avoiding the formation of turbulent liquid molten metal within the shot tube until the bore of the shot tube in front of the shot tip is substantially devoid of air; and thereafter accelerating the shot tip to rapidly fill die cavity; and thereafter applying increasing pressure to the molten metal in the die cavity until it has substantially solidified.

7. The method of claim 6 further comprising the step of applying a vacuum to the part-forming cavity during advancement of the shot tip.

8. The method of claim 7, wherein said vacuum is not applied to the die-forming cavity until the shot tip has advanced a distance equal to about $L_T$–$L_V$.

9. The method of claim 6, wherein said shot tube is provided with a vent opening having a diameter $D_V$ selected, as follows:

| $D_T$ (inches) | $D_v$ (inches) |
|---|---|
| <3 | 0.62 |
| 3 to 4 | 0.75 |
| 4 to 5.5 | 1.00 |
| >5.5 | 1.50 |

10. The method of claim 6, wherein increasing pressure is applied to the molten metal within the part-forming cavity at an average rate of from about 5,000 psi per second to about 12,000 psi per second to reach maximum pressure.

11. The method of claim 10, wherein the maximum rate of application of pressure is less than about 20,000 psi per second.

12. The method of claim 10, wherein the average rate of pressure application is less than 12,000 psi per second.

13. The method of claim 12, wherein the average rate of pressure application is about 6,000 psi per second.

14. In a die casting apparatus, a die having a part-forming die cavity having a volume $V_M$;

a shot tube having a bore with a diameter $D_T$ and a shot stroke length $L_T$ and volume $V_T$ connected with the die cavity, and also having a pour opening at its rear for the introduction of molten metal, said shot tube having a shot tip reciprocatably carried within the shot tube bore between its rear end and its distal end said distance $L_T$;

a vent opening located a distance equal to $V_M$ divided by $V_T$ times $L_T$ from its distal end, said vent opening having a diameter dependent upon the diameter of the shot tube bore and selected as follows:

| $D_T$ (inches) | $D_v$ (inches) |
|---|---|
| <3 | 0.62 |
| 3 to 4 | 0.75 |
| 4 to 5.5 | 1.00 |
| >5.5 | 1.50 |

first means for introducing a volume $V_M$ of molten metal through the pour opening and within the bore of the shot tube between the shot tip and the distal end of the shot tube; and second means for advancing the shot tip toward the distal end of the shot tube to force molten metal into the die cavity;

said second means being operable to accelerate the shot tip to a velocity less than about 18 inches per second to form a rising but non-turbulent wave of molten metal in front of the shot tip until it has traveled a distance $L_T$–$L_V$ and to thereafter accelerate the shot tip at a rapid rate until the die cavity is filled with molten metal, and being operable to exert extremely high pressure on the molten metal.

15. The apparatus of claim 14 further comprising receiving means for impressing a vacuum on the part-forming cavity and means for controlling said vacuum means to impress the vacuum on the part-forming cavity after the shot tip has advanced a distance $L_T$–$L_V$.

16. The apparatus of claim 14, wherein the shot tip is advanced at a velocity of about 16 inches per second until the shot tip has traveled a distance equal to $L_T$–$L_V$.

* * * * *